United States Patent [19]

Marcus

[11] Patent Number: 4,818,599

[45] Date of Patent: Apr. 4, 1989

[54] POLYESTER FIBERFILL

[75] Inventor: Ilan Marcus, Versoix, Switzerland

[73] Assignee: E. I. DuPont de Nemours and Company, Wilmington, Del.

[21] Appl. No.: 180,150

[22] Filed: Apr. 13, 1988

Related U.S. Application Data

[63] Continuation of Ser. No. 921,646, Oct. 21, 1986, abandoned.

[51] Int. Cl.[4] ..... D04H 1/04

[52] U.S. Cl. ..... 428/288; 156/62.6; 156/180; 156/290; 156/308.2; 428/198; 428/224; 428/296; 428/297; 428/360; 428/362; 428/373; 428/375; 428/378

[58] Field of Search ..... 428/198, 224, 288, 296, 428/297, 360, 362, 373, 378, 375; 156/62.6, 180, 308.2, 290

[56] References Cited

U.S. PATENT DOCUMENTS

| | | | |
|---|---|---|---|
| 3,416,952 | 12/1968 | McIntyre et al. | 117/118 |
| 3,557,039 | 1/1971 | McIntyre et al. | 260/29.2 |
| 3,619,269 | 11/1971 | McIntyre et al. | 117/118 |
| 3,702,260 | 11/1972 | Jayne et al. | 117/100 |
| 3,981,807 | 9/1976 | Raynolds | 252/8.8 |
| 4,520,066 | 5/1985 | Athen | 428/362 |

FOREIGN PATENT DOCUMENTS

| | | |
|---|---|---|
| 66994 | 12/1982 | European Pat. Off. . |
| 159882 | 10/1985 | European Pat. Off. . |

*Primary Examiner*—James J. Bell

[57] ABSTRACT

Blends of polyester fiberfill and binder fiber, wherein the fiberfill is coated with a hydrophilic poly(alkylene oxide) type finish that cures on to the polyester fibers and so provides improved properties in the eventual bonded product, including combinations of improved durability, soft hand, good bonding, reduced flammability and improved moisture transport.

15 Claims, No Drawings

POLYESTER FIBERFILL

This is a continuation of application Ser. No. 921,646, filed 10/21/86, now abandoned.

TECHNICAL FIELD

This invention concerns improvements in polyester fiberfill material, commonly referred to as polyester fiberfill, and more particularly to providing polyester fiberfill in a form that is especially adapted for blending with binder fibers, to such blends as can be thermally bonded to provide useful bonded products having advantageous properties, such as bonded batts, and to the resulting bonded batts and other products incorporating the same.

BACKGROUND OF INVENTION

Polyester fiberfill is used commercially in many garments and other articles, such as sleeping bags, cushions, comforters and pillows. A particularly useful and desirable form of polyester fiberfill has a coating of cured polysiloxane, often referred to as silicone slickener, e.g. as disclosed in Hofmann U.S. Pat. No. 3,271,189 and Mead et al. U.S. Pat. No. 3,454,422, because certain desirable properties, such as hand, bulk-stability and fluffability are improved thereby. Despite the widespread commercial use of such silicone-slickened-polyester fiberfill, it has long been recognized that this coating has an important disadvantage, together with the desirable qualities. As reported by Pamm U.S. Pat. No. 4,281,042 and Frankosky U.S. Pat. No. 4,304,817, a silicone coating makes it almost impossible to bond the polyester fiberfill at cross-over points, especially when blends of only slickened polyester fiberfill and binder fiber are heat-treated, so as to activate the binder fiber. Any bonds are very poor and seem to be the result of bonding between residues of any binder fibers that were bicomponent fibers, whose cores remain after bonding. Thus it is not practical to use such silicone-slickened fiberfill to form a through-bonded batt or molded article that is properly bonded and durable, as is desirable in some end-uses.

The main object of the present invention is to provide a properly through-bonded batt having advantages of the type that have been obtainable previously only from unbonded slickened materials, e.g. in hand, in combination with the improved performance (especially durability) that has only been attainable previously with bonded batts from "dry" fiberfill. Another object is to improve the resilience and structure stabilization of slickened fiberfill products. Other objects will appear hereinafter.

Reference is made here to Jayne et al. U.S. Pat. No. 3,702,260. Jayne discloses surface-modified polyester fiberfill products having improved compressional recovery and other outstanding properties (see paragraph from column 2–column 3) and to a method for providing such fiberfill products. The coating is co-crystallized on the surface of the crimped polyester staple fiber, and consists of a copolyester comprising about 20–95% by weight of poly(oxyalkylene) units and about 80–5% by weight of ester units identical to those present in the polyester staple fiber substrate. Batts of such coated fibers may be bonded or unbonded and are preferably unbonded (column 2, lines 57–59). Bonding resins may be applied to the batts to prevent any later fiber leakage and/or to prevent shifting of the batting in end-use applications, e.g. by spraying on both sides of the surface in the form of water emulsions, followed by drying and curing (column 5, lines 15–21). Jayne does not mention binder fibers, and Jayne's fiberfill has not been used commercially, so far as is known.

SUMMARY OF THE INVENTION

I have found that, by replacing the existing commercial silicone slickeners with a hydrophilic coating containing poly(alkylene oxide) chains or segments on the surface of the polyester fiberfill, it is possible to attain the desired object and other advantages. Thus such coated polyester fiberfill can be bonded more effectively than silicone-slickened fiberfill, e.g. from blends with binder fiber, and has other advantages in reduced flammability and improved moisture transport, as will be mentioned hereinafter. It is believed important to ensure that the hydrophilic coating is "cured" properly onto the polyester fibers, in other words, that the poly(alkylene oxide) chains are essentially permanently affixed to the surface of the polyester fibers, i.e. so that they will not be removed by washing or by other treatments that will be encountered in normal processing or use.

Accordingly, there is provided an improved polyester fiberfill blend consisting essentially of, by weight, (a) from about 60 to about 95% of crimped polyester staple fiber, and (b) complementally, to total 100%, from about 5 to about 40% of crimped staple binder fiber, comprising a polymer having a binding temperature lower than the softening temperature of the said polyester staple fiber, characterized in that the said polyester staple fiber has a coating cured thereto of a slickener consisting essentially of chains of poly(alkylene oxide).

Two commercial poly(alkylene oxide) copolymers, involving two different mechanisms of "curing" are described more particularly below. One is a block copolymer of poly(ethylene oxide) and poly(ethylene terephthalate) which, when applied to the surface of a polyester fiber containing repeat units of poly(ethylene terephthalate), and cured at about 170° C., is fixed to the fiber. The mechanism by which it is cured is not fully understood, but is suggested to be the co-crystallization of the polyester segments on the polyester fiber. Another curing mechanism is effected by cross-linking poly(alkylene oxide) chains modified with reactive groups capable of cross-linking with or without the addition of catalysts or cross-linking agents. Both these routes can be effected by using commercially available polymers with large segments of poly(ethylene oxide) and/or poly(propylene oxide), poly(ethylene oxide) being preferred.

According to one aspect of the invention, therefore, there is provided a polyester fiberfill blend consisting essentially of, by weight, (a) from about 60 to about 95%, preferably about 80 to about 90%, of crimped polyester staple fiber and (b), complementally to total 100%, from about 5 to about 40%, preferably about 10 to about 20%, of crimped staple binder fibers, comprising a polymer having a melting point lower than that of the polyester staple fiber, wherein the polyester staple fiber is coated with a segmented copolymer of poly(ethylene terephthalate) and poly(ethylene oxide) in amount from about 0.1 to about 1% by weight of the polyester staple fiber.

According to another aspect of the invention, there is provided a polyester fiberfill blend consisting essentially of (a) from about 60 to about 95% by weight of crimped polyester staple fiber and (b) complementally to total 100% by weight, from about 5 to about 40% by weight of crimped staple binder fibers, comprising a polymer having a melting point lower than that of the polyester staple fiber, wherein the polyester staple fiber is coated with a modified poly(alkylene oxide) grafted with functional groups to permit cross-linking, in amount from about 0.1 to about 1% by weight of the polyester staple fiber.

Use of these blends makes possible the provision of bonded fiberfill products with advantages over products that have hitherto been available commercially, as will be indicated in more detail hereinafter, but can be summarized as:

Improved performance, especially durability, as compared with "dry" (i.e. non-slickened), fiberfill that has been available commercially.

Soft hand in combination with the structure stabilization and resilience that results from good bonding.

Good moisture transport.

Lack of flammability, comparable with that resulting from "dry" fiberfill, and such as I have not obtained with prior commercial silicone-slickened fiberfill.

DETAILED DESCRIPTION OF THE INVENTION

An important element of the present invention is the use of an appropriate coating material to provide the desired hydrophilic coating of poly(alkylene oxide) chains on the polyester fiberfill. As already indicated, some of these materials are available commercially.

Coating materials that are suitable for use according to the invention include segmented copolyesters consisting essentially of poly(ethylene terephthalate) segments and of poly(alkylene oxide) segments, derived from a poly(oxyalkylene) having a molecular weight of 300 to 6,000. Several such copolyesters and dispersions thereof are disclosed in McIntyre et al. U.S. Pat. Nos. 3,416,952, 3,557,039 and 3,619,269, and in various other patent specifications disclosing like segmented copolymers containing poly(ethylene terephthalate) segments and poly(alkylene oxide) segments. Preferably the poly(alkylene oxide) will be a poly(ethylene oxide), which is also of commercial convenience. One such product is available commercially from ICI America Inc. as a textile finishing agent and is sold under the trademark "ATLAS" G-7264. This product is sold in Europe by ICI Specialty Chemicals, Brussels. Another is sold as "ZELCON" 4780, by E. I. du Pont de Nemours and Company. Other materials are disclosed in Raynolds U.S. Pat. No. 3,981,807. Other suitable materials include modified poly(ethylene oxide)/poly(propylene oxide) grafted with functional groups to permit cross-linking e.g. by treatment with 5% by weight of citric acid. Such a product is available commercially from Union Carbide as "UCON" 3207A. Other materials that may include particularly useful compositions are disclosed in Teijin EP No. 159882 and ICI Americas, EP No. 66944. Further discussion is given in my copending applications, No. DP-3720-B and No. DP-4185, filed simultaneously herewith.

The coating material can be applied to the polyester fiber either on the crimped staple or, preferably, on the tow, especially after drawing, in the crimping chamber. It is cured onto the fiber, by a process which is said to involve co-crystallizing or crosslinking, depending on the nature of the material. The fiberfill can then be blended with the binder and packed, or can be packed separately and be blended with the binder fiber prior to processing the product on standard batt manufacturing equipment. In any case the batt is generally processed, e.g. in an oven, to bond the binder to the fiberfill, and to achieve the special properties of the battings described herein. The coating can also be applied to the fiberfill staple at the end of the process line, after cutting and prior to packing, without curing, then be blended with the binder fiber. The blend is then processed on the standard carding equipment and the curing can take place in the oven at the same time as the bonding by the binder. These coating materials, however, generally produce better results when they are applied prior to or during crimping, as the reduced fiber to fiber friction favors the formation of smoother crimp, which can also contribute to an improved durability and increased softness, and the bonding appears to be better as a result of the earlier curing. The binder fiber blend is processed on commercial carding equipment, cross-lapped, and heat-treated in an oven to bond the fiberfill and the binder fiber.

The binders are preferably heat-activated, i.e. they melt or soften at temperatures some 50° C. or more below the melting points of the polyester fiberfill, so that the bonding does not affect the integrity of the fiberfill itself. Commercially available sheath/core 50/50 bicomponent binder fibers with a core of poly(ethylene terephthalate) homopolymer and sheath of a copolymer of poly(ethylene terephthalate/isophthalate) (60/40), modified to reduce its melting point, have been used with poly(ethylene terephthalate) fiberfill in the manufacture of the battings of the invention. Although sheath/core binder fibers are preferred, single component binders can also be used with an improvement over the controls made from the same binder and fiberfill without the coating. The denier of the binder fiber will generally be between about 3 to about 30 dtex, preferably less than about 20 dtex. Further information about binder fibers is given in my copending application No. DP-3720-B, filed simultaneously herewith and in U.S. Pat. Nos. 4,281,042 and 4,304,817.

The fiberfill can be of about 1 to about 30 dtex, can be solid or hollow, with single or multiple voids, and have a round or an odd cross section.

The lower deniers are used mainly in applications where the thermal insulation is an important factor, such as apparel, sleeping bags and special bedding articles for institutional applications. For these applications the blends of the invention have shown several advantages over commercially-available polyester slickened batts or binder fiber blends. The bonded batts have shown a combination of softness and good bonding with good thermal insulation. The loft and softness have been maintained after many washings, because of the resistance of the coating to washing, and the excellent tear resistance of the batts has been shown, as a result of good bonding with the binder fiber core. The performance of these bonded batts is very surprising, in view of the previous difficulty in bonding fiberfill slickened with prior art silicone slickeners. The batts combine this desirable softness with a low flammability such as is characteristic of batts from non-slickened fibers, and which also contrasts with the flammability of fibers slickened with silicones.

DESCRIPTION OF TEST METHODS

Bulk measurements were made conventionally on an Instron machine to measure the compression forces and the height of each sample pillow or cushion, which was compressed with a foot of appropriate diameter (10 or 20 cm) attached to the Instron.

Foot B (20 cm diameter) is used for lower density products (e.g. pillows) with a maximum pressure of 100N, and support bulk (SB) at 30N (representing the height in cm of the pillow under the weight of an average head). The softness, in this instance, corresponds to the difference in height (in cm) between the initial height at the beginning of the second compression cycle ($IH_2$) and the support bulk; i.e. the (absolute) softness $=IH_2-SB$ (height at 30N). Softness is sometimes expressed as relative softness, i.e. as a percentage of $IH_2$.

Foot A (10 cm diameter) is used for higher density products (e.g. furnishing cushions, mattresses) with maximum pressure (the same as support bulk, in this instance) at 60N (corresponding to the pressure exerted by a sitting person). The softness, in this instance, corresponds to the difference in height between the initial height at the beginning of the second compression cycle ($IH_2$) and the height under 7.5N; i.e. the (absolute) softness, in this instance, $=IH_2-$bulk at 7.5N. Again, softness is sometimes expressed as relative softness, relative to $IH_2$. The firmness of a cushion correlates with a strong support bulk, and is inversely related to softness.

Resilience is measured as Work Recovery (WR), i.e. the ratio of the area under the whole recovery curve calculated as a percentage of that under the whole compression curve. The higher the WR, the better the resilience.

Durability—Several layers of each batting (50×50 cm) were stacked to provide a weight of about 850 g. The number of layers was adjusted to provide pillows with minimal weight differences. These were covered with a fabric and measured with foot A. The initial density of the pillows was between 12 and 15 g/l, depending on the bulk of the individual item. These lower density "pillows" were repeatedly compressed to a maximum pressure of 1,225N at a rate of 1,200 cycles/hour for 10,000 cycles. The pillows were remeasured and the bulk losses calculated.

Another series of cushions was prepared by stacking a number of layers to produce cushions with 850±15 g. The cushions were compressed using buttons to produce furnishing back cushions with a density of 25–28 g/l (depending if the measurement is done on the crown or in the vicinity of the buttons). These back cushions were submitted to a stomping test using the shape of a human bottom with an area of 37×43 cm and a pressure of 8.8 kPa. The stomping was repeated at a rate of about 1,000 cycles/hour for 10,000 cycles. The cushions were remeasured after the testing and the bulk losses calculated.

Flammability: Two tests were used:

The methanamine pill test is based on the U.S. Federal Method, Flammability Standard for Carpets DOC FF 1-70.

The 45 deg. open flame test DIN 54335.

The area destroyed was measured and recorded in both cases, and the rate of propagation of the flame also recorded in the open flame test.

Strength: The grab test DIN 53857 evaluates the strength of the bonding. (The results herein are normalized to a common basis of 200 g/sq.m.).

Laundry Tests: One layer (40×40 cm) of each batting is quilted (in apparel fabric) and sewn in the middle. The compression of two layers is measured by Instron (foot B-20 cm diameter, maximum pressure 240N). All the samples are washed together in a washing machine at 40° C. for three complete cycles. The samples were remeasured after laundry and the difference in thickness was calculated.

The invention is further illustrated in the following Examples. All parts and percentages are by weight, unless otherwise indicated. All heights are measured in cm, and are sometimes expressed as 'Bulk'.

EXAMPLE 1

A commercial hollow unslickened polyester fiberfill (6.1 dtex) was coated with 0.35% by weight (solids) of a hydrophilic slickener by spraying with an aqueous solution containing 2.8% solids of "ATLAS" G-7264, obtained by diluting the commercial emulsion (14%) with 5X its weight of water, and then dried in air at room temperature. The coated staple was blended (85/15) with the above-mentioned sheath/core binder fiber of 4.4 dtex. This blend was processed to produce a 1 meter wide batt of density about 180 g/sq. m. by superposing four parallel layers without crosslapping. This batt was heat bonded in a commercial 3.5 m. wide oven at a temperature of 160° C.; this heat treatment had the dual effect of curing the coating to the polyester fiberfill and of activating the binder sheath of the binder fiber so as to bond the batt. Various properties of the bonded batt are measured and recorded in tests which clearly demonstrate the superiority of this item of the invention 2 over control item 1, which was prepared in exactly the same way from the same basic commercial fiberfill and binder fiber except that no hydrophilic poly(ethylene oxide)-containing coating was applied. Both products were processed under otherwise identical conditions, and were bonded by heat-treating in parallel in the same oven at the same time.

1—The test batt 2 was much softer and more drapable, but very different from silicone-slickened products.

2—Table 1 shows the improved softness and durability over the control.

3—Bonding to the binder fiber was far better than with 0.3% silicon-slickener, being 70% of control's strength in machine direction and 50% in the transverse direction, which is not very significant as there was no cross-lapping in this Example.

4—Flammability of the test item 2 was very close to the control 1 with 1.0 second flame duration (=control) and 8.4 cm destroyed length versus 6.0 for the control, whereas silicon-slickened batting was totally destroyed with flame duration of 40 seconds.

TABLE 1

| | Height (Ca) | | | | | | | | | Softness | | | | | | Work Rec. % | | |
|---|---|---|---|---|---|---|---|---|---|---|---|---|---|---|---|---|---|---|
| | IH2 | | | 30 N | | | 100 N | | | ABSOL. (Ca) | | | Rel. (%) | | | % | | |
| | BF | AF | Δ | BF | AF | Δ | BF | AF | Δ | BF | AF | Δ | BF | AF | Δ | BF | AF | Δ |
| Control 1 | 15.4 | 13.9 | −9.4 | 9.6 | 7.9 | −17.5 | 5.9 | 4.6 | −22.1 | 5.8 | 6.0 | 3.8 | 37.7 | 43.3 | 14.9 | 60.8 | 59.8 | −1.7 |

TABLE 1-continued

| | Height (Ca) | | | | | | | | | Softness | | | | | | Work Rec. % | | |
|---|---|---|---|---|---|---|---|---|---|---|---|---|---|---|---|---|---|---|
| | IH2 | | | 30 N | | | 100 N | | | ABSOL. (Ca) | | | Rel. (%) | | | % | | |
| | BF | AF | Δ | BF | AF | Δ | BF | AF | Δ | BF | AF | Δ | BF | AF | Δ | BF | AF | Δ |
| Invention 2 | 14.4 | 13.7 | −5.1 | 7.7 | 6.7 | −12.2 | 3.5 | 3.4 | −11.5 | 6.8 | 7.0 | 2.8 | 46.9 | 50.7 | 8.2 | 59.9 | 57.1 | −3.1 |

BF = before flex test
AF = after flex test
Δ = % loss of height due to flex test Although this coated fiberfill had not been pre-cured (i.e. had not been heat-treated prior to the bonding treatment), the break strength of the batting was surprisingly high, being about 70% of that of the control, thereby demonstrating that good bonding of the coating to the fiberfill had occurred. The following Examples shows the improvements obtained by curing the coating, and using cross-lapped webs.

EXAMPLE 2

1. This is a control described below.

2. The same 6.1 dtex hollow dry crimped commercial polyester fiberfill staple substrate is coated with 0.35% solids following essentially the procedure described in Example 1, and the coating is then cured onto the fiber by heating the staple at 170° C. for 5 minutes. The cured coated fiberfill is then blended with the same sheath-/core binder fiber as in Example 1 in the same proportions (85/15). This blend is processed on a card and cross-lapper to produce a batt of density about 190 g/sq.m., and is bonded in an oven at 160° C. at a speed of 1 m/min. The following Tables compare the properties of this bonded batt as item 2 with a control batt (item 1) prepared from the same substrate polyester fiberfill without the hydrophilic coating according to the invention, and with other batts made as follows:

3. The same basic polyester fiberfill substrate is coated with 0.35% solids by spraying with a 20% solution of UCON 3207A (with the addition of 5% of citric acid), and cured as for item 2 above.

4. This is a control, similar to item 1, but using hollow crimped polyester fiberfill of 13 dtex, with the same 4.4 dtex binder fiber.

5. This is similar to control item 4, except that the polyester fiberfill is coated with 0.35% of "ATLAS" G-7264 on the 13 dtex fiberfill, and cured as in item 2.

6. This is similar to item 2 above, except that the polyester fiberfill substrate is coated as a tow under plant conditions, by applying an 8.2% emulsion in water of "ATLAS" G-7264 to produce the same solids coating of 0.35% on the fiber. The tow was then relaxed at a temperature of 175° C. to cure the coating and set the crimp. The relaxed tow was cut blended to a cut length of 60 mm with a tow of the sheath/core binder fiber to produce a blend of 85/15 fiberfill/binder. The blend was converted into a batt, and the batt was heat bonded under essentially the same conditions described.

7. This item was produced essentially as for item 6, except that the coating was provided from UCON 3207A, as in item 3.

To summarize: Items 1 and 4 are controls, items 2, 5 and 6 are coated with ATLAS G-7264, while items 3 and 7 are coated with UCON 3207A; items 2, 3 and 5 are coated in staple form, and cured at 170° C., whereas items 6 and 7 are coated in tow form, before setting the crimp at 175° C.; items 1–3, 6 and 7 have fiberfill of dtex 6.1, whereas items 4 and 5 are of 13 dtex.

It will be noted that the weights and densities of the batts are not identical. To get proper comparisons, where indicated, the measurements have been "normalized" by calculating equivalents all at the same weight of 200 g/m$^2$.

Table 2 gives the compression data for all 7 bonded batts, to show good results, i.e. good bonding occurred in every case, in contrast with silicone-slickened fiberfill that cannot be bonded in this manner.

Tables 3, 4 and 5 give flammability data. It will be noted that none of the items showed flammability, and the areas destroyed were comparable to controls 1 and 4, in which unslickened (dry) fiberfill was used, i.e. the fiberfill coatings have not significantly increased flammability over that dry fiberfill. In contrast, flammability tests were made on controls 8 and 9, to show the well-known flammability associated with silicone-slickened products. Control 8 was a batt entirely of commercial silicon-slickened fiberfill, otherwise as used in Examples 1 and 2 except for the silicone-slickener. Control 9 was from a 60/20/20 blend of 60% unslickened fiberfill, as used in Examples 1 and 2, with 20% slickened fiberfill, as used in Control 8, and 20% of the binder used in Examples 1 and 2; this shows that even the addition of a minor proportion of silicone-slickened fiberfill causes a very significant increase in flammability, which is undesirable. The flammability tests did not warrant normalization.

Table 6 shows the breaking strength measurements. The top set gives the actual measurements and the different weights of each batt, while the lower set gives calculated measurements all normalized to the same weight of 200 g/m$^2$, since this is a better comparison which somewhat favors control 1 of lower weight. The significantly superior breaking strength of preferred item 6 is most impressive. The low figures of items 3 and 7 are speculated to be because of the nature of the coating, and better results would be expected from an analogous coating based on poly(ethylene oxide) chains, such as is preferred, but it is significant that when these coatings give significant bonding, in contrast to silicone-slickened fiberfill which gives products having virtually no bonding (except possibly between the residues of the bicomponent binder fibers). These strength tests are only indirectly related to durability in furnishing, but demonstrates the strong bonding, which partly explains the good support bulk figures and durability.

Table 7 shows the results of the delamination test, and again shows the strength of the bonds between the layers, especially for preferred item 6, which is much better than the control. This is a very important test, since delamination is a major cause of failure in some constructions in furnishings and mattresses, and is important also in sleeping bags and sportswear.

Table 8 contains two sets of data; bulk in condensed cushions and non-condensed "pillows". Included is a Trade Control (from an 85/15 blend of dry fiberfill-/binder) i.e. otherwise like item 1. On one hand, it demonstrates the bulk advantage that is still important even in higher density 100% fiber cushions at densities of 25–28 g/l. On the other hand, it demonstrates the bulk advantage of the products of the invention. This refers to non-condensed material with 6 superposed layers (not making any corrections for the differences in weight and height between the products). The same "pillows" were used for the durability tests covered in Table 9. This will reflect what a customer, using the product for foam-wrapped cushions or for other applications with a lower pressure, will see (.e.g sportswear, sleeping bags, etc.)

These data in Table 8 call for several remarks:

Bulk is very important in furnishing and mattresses and corresponds, to real market need.

The advantage of the products of the invention, particularly item 6, is in reality much bigger than one can seen from a quick look at the data. Not only it has higher bulk than the best control known to to be available from the trade, but also has same advantage at much lower density. (Thicker batt=lower density in terms of g/l.)

The differences in batt height and weight create the same interpretation problem as with the durability data. The product which has much more height has a lower density and is therefore at disadvantage. To overcome this problem with the existing samples and to demonstrate the durability advantage, I condensed the products into cushions, with approximately the same density, and subjected them to the durability test.

Table 9 summarizes the durability data in cushions only for item 6 and for the Trade Control, but for the "pillows" of all items. It has to be studied together with the corresponding height measurements summarized in Tables 2 and 8. The durability of item 6, which is a 6,1 dtex of the invention, is almost equal to the control 13 dtex (which is close in bulk to item 6). It is equivalent to the best trade control, although this product has a much lower bulk. Therefore, the test item can be expected to perform better at an equal weight and height basis. Essentially all test items performed equal to or better than the controls, particularly taking into account the low bulk (high density) of control item 1.

Table 10 show the change in bulk after 3 home laundries at 40° C. This shows again the good performance of most products of the invention, as these have the lowest changes, although items 6 and 7 have a considerably higher bulk than the control. The only exception is item 3, which may reflect defects in the preparation of this item.

TABLE 2

| Item No. | 1 | 2 | 3 | 4 | 5 | 6 | 7 |
|---|---|---|---|---|---|---|---|
| Initial Heights: | | | | | | | |
| 1st cycle ($IH_2$) | 8.3 | 8.9 | 10.7 | 11.9 | 11.2 | 12.9 | 12.0 |
| 2nd cycle | 7.7 | 8.4 | 9.2 | 11.6 | 10.0 | 12.0 | 10.9 |
| 2nd Cycle - Heights under indicated loads (SB) | | | | | | | |
| 2N | 7.6 | 8.3 | 9.1 | 11.4 | 9.9 | 11.9 | 10.8 |
| 5N | 5.6 | 5.6 | 6.5 | 8.5 | 7.6 | 10.5 | 8.8 |
| 10N | 4.6 | 4.7 | 5.2 | 7.1 | 6.3 | 9.3 | 7.6 |
| 30N | 3.1 | 3.1 | 3.1 | 4.4 | 4.0 | 6.7 | 5.1 |
| 60N | 2.1 | 2.2 | 1.9 | 2.8 | 2.6 | 4.6 | 3.5 |
| 100N | 1.5 | 1.6 | 1.4 | 1.8 | 1.8 | 3.2 | 2.4 |
| 160N | 1.1 | 1.2 | 1.0 | 1.2 | 1.3 | 2.2 | 1.7 |
| 240N | 0.9 | 1.0 | 0.8 | 0.9 | 1.0 | 1.6 | 1.3 |
| Int. Compr. Height | 0.7 | 0.7 | 0.8 | 1.1 | 1.0 | 1.7 | 1.3 |
| Total Int. Height | 1.6 | 1.7 | 1.6 | 2.0 | 2.0 | 3.3 | 2.6 |
| Softness: | | | | | | | |
| Abs. | 4.6 | 5.3 | 6.1 | 7.2 | 6.0 | 5.3 | 5.8 |

TABLE 2-continued

| Item No. | 1 | 2 | 3 | 4 | 5 | 6 | 7 |
|---|---|---|---|---|---|---|---|
| Rel. | 59.7 | 63.1 | 66.3 | 62.1 | 60.0 | 44.2 | 53.2 |
| Work | 63.6 | 70.8 | 59.8 | 55.6 | 62.9 | 67.0 | 61.8 |
| Recovery: | | | | | | | |
| Weight g/m² | 190.4 | 234.4 | 205.0 | 203.4 | 239.6 | 221.5 | 199.6 |

TABLE 3

FLAMMABILITY TEST @ 45° C. (DIN 54'335) SHOWING THE AREA DESTROYED (Flame Length = 4.0 cm AND Exposure time = 15 seconds)

| Identification | DURATION OF FLAME (IN SECONDS) WHEN EXPOSED 5.0 cm | 30.0 cm | 55.0 cm | Total (sec) | AREA DESTROYED ($cm^2$) |
|---|---|---|---|---|---|
| Item 1 | 0 | 0 | 0 | 0 | 6.2 |
| Item 2 | 0 | 0 | 0 | 0 | 5.8 |
| Item 3 | 0 | 0 | 0 | 0 | 5.0 |
| Item 4 | 0 | 0 | 0 | 0 | 7.0 |
| Item 5 | 0 | 0 | 0 | 0 | 7.4 |
| Item 6 | 0 | 0 | 0 | 0 | 8.0 |
| Item 7 | 0 | 0 | 0 | 0 | 10.2 |
| Control 8 | 6.0 | 55.0 | 76.0 | 137.0 | 504.0 |
| Control 9 | 10.0 | 65.0 | 80.0 | 155.0 | 504.0 |

TABLE 4

FLAMMABILITY TEST @ 45° C. (DIN 54'335) SHOWING THE FLAME VELOCITY (Flame Length = 4.0 cm AND Exposure Time = 15 seconds)

| Identification | VELOCITY OF FLAME IN (CM/MIN.) SPREAD FOR 2.0 minutes | 3.0 minutes |
|---|---|---|
| Item 1 | 0.0 | 0.0 |
| Item 2 | 0.0 | 0.0 |
| Item 3 | 0.0 | 0.0 |
| Item 4 | 0.0 | 0.0 |
| Item 5 | 0.0 | 0.0 |
| Item 6 | 0.0 | 0.0 |
| Item 7 | 0.0 | 0.0 |
| Control 8 | 54.6 | 72.4 |
| Control 9 | 41.3 | 46.2 |

TABLE 5

FLAMMABILITY PILL (METHANAMINE) TEST SHOWING THE AREA DESTROYED (After 15 seconds of exposure)

| Identification | DESTROYED AREA IN ($cm^2$) | COMBUSTION OF THE PILL (sec.) |
|---|---|---|
| Item 1 | 12.64 | Avg: 1'27 |
| Item 2 | 14.51 | 1'30 |
| Item 3 | 15.54 | 1'31 |
| Item 4 | 11.19 | 1'30 |
| Item 5 | 12.94 | 1'31 |
| Item 6 | 14.53 | 1'31 |
| Item 7 | 13.53 | 1'31 |
| Control 8 | 82.02 | 1'30 |
| Control 9 | 67.39 | 1'30 |

TABLE 6

GRAB TEST IN (N) SHOWING THE TEARING STRENGTH OF THE BATTS

| Identification | Weight (g/$cm^2$) | Machine Direction (M.D.) | Cross Direction (X.D.) |
|---|---|---|---|
| Item 1 | 190.4 | 19.2 | 70.3 |
| Item 2 | 234.4 | 25.1 | 67.4 |
| Item 3 | 205.0 | 7.8 | 29.3 |
| Item 4 | 203.4 | 15.8 | 48.7 |
| Item 5 | 239.6 | 19.7 | 43.9 |

TABLE 6-continued

| GRAB TEST IN (N) SHOWING THE TEARING STRENGTH OF THE BATTS | | | |
|---|---|---|---|
| Identification | Weight ($g/cm^2$) | Machine Direction (M.D.) | Cross Direction (X.D.) |
| Item 6 | 221.5 | 64.3 | 186.0 |
| Item 7 | 199.6 | 12.0 | 53.0 |
| Normalized Strengths for Weight (200 $g/m^2$) | | | |
| Item 1 | | 20.2 | 73.8 |
| Item 2 | | 21.4 | 57.5 |
| Item 3 | | 7.6 | 28.6 |
| Item 4 | | 15.5 | 47.9 |
| Item 5 | | 16.4 | 45.0 |
| Item 6 | | 58.1 | 167.9 |
| Item 7 | | 12.0 | 53.1 |

TABLE 8

| BULK AT 7.5N DATA IN (CM) OF HIGH DENSITY (CONDENSED) CUSHIONS (25-28 g/l) & LOWER DENSITY (NON-CONDENSED) (12 g/l) (60 × 60 CM) | | |
|---|---|---|
| Identification | Bulk at 7.5N (cm) (condensed cushions) | Bulk at (non-condensed pillows) |
| Item 1 | 8.35 | 9.02 |
| Item 2 | 13.15 | 10.45 |
| Item 3 | 12.35 | 8.55 |
| Item 4 | 13.88 | 10.95 |
| Item 5 | 13.25 | 10.7 |
| Item 6 | 14.2 | 11.75 |
| Item 7 | 13.7 | 10.0 |
| Trade Control | 13.53 | 9.45 |

TABLE 9

DURABILITY DATA SHOWING THE LOSSES IN INITIAL HEIGHT & BULK AT 7.5N BEFORE AND AFTER STOMPING (60 × 60 CM)

| A. Condensed Cushions at 25-28 g/l | Trade Control | Item 6 |
|---|---|---|
| Initial Height (cm): | | |
| Before Stomping | 14.8 | 16.3 |
| After Stomping | 13.28 | 15.38 |
| Abs. Diff. (cm) | 1.52 | 0.92 |
| Diff. (%) | −10.27 | −5.64 |
| Bulk at 7.5N (cm): | | |
| Before Stomping | 13.53 | 14.2 |
| After Stomping | 11.63 | 12.7 |
| Abs. Diff. (cm) | 1.9 | 1.5 |
| Diff. (%) | −14.04 | −10.6 |

| B. Non-Condensed Pillows of 12 g/l | | | | | | | | |
|---|---|---|---|---|---|---|---|---|
| Item No. | 1 | 2 | 3 | 4 | 5 | 6 | 7 | Control |
| Initial Height (cm): | | | | | | | | |
| Before Stomping | 13.20 | 15.05 | 13.1 | 14.22 | 14.5 | 17.17 | 15.47 | 12.4 |
| After Stomping | 11.3 | 12.87 | 10.72 | 11.9 | 12.52 | 14.52 | 13.07 | 10.08 |
| Abs. Diff. (cm) | 1.9 | 2.18 | 2.38 | 2.32 | 1.98 | 2.65 | 2.4 | 2.32 |
| Diff. (%) | −14.39 | −14.49 | −18.17 | −16.32 | −13.66 | −15.43 | −15.51 | −18.71 |
| Bulk at 7.5N (cm): | | | | | | | | |
| Before Stomping | 9.02 | 10.45 | 8.55 | 10.95 | 10.7 | 11.75 | 10.0 | 9.45 |
| After Stomping | 7.17 | 8.3 | 6.70 | 8.35 | 8.07 | 8.7 | 7.75 | 7.0 |
| Abs. Diff. (cm) | 1.85 | 2.15 | 1.85 | 2.6 | 2.63 | 3.05 | 2.25 | 2.45 |
| Diff. (%) | −20.51 | −20.57 | −21.64 | −23.74 | −24.58 | −25.96 | −22.54 | −25.93 |

TABLE 7

| DELAMINATION TEST IN (N) SHOWING THE BONDING STRENGTH FROM LAYER TO LAYER | | | |
|---|---|---|---|
| Identification | | Machine Direction (M.D.) | Cross Direction (X.D.) |
| Item 1 | Avg(N): | 7.1 | 7.7 |
| | CV (%): | 2.7 | 11.1 |
| Item 2 | Avg(N): | 7.0 | 8.3 |
| | CV (%): | 10.0 | 7.7 |
| Item 3 | Avg(N): | 2.7 | 3.6 |
| | CV (%): | 5.8 | 2.1 |
| Item 4 | Avg(N): | 5.4 | 7.0 |
| | CV (%): | 8.8 | 12.2 |
| Item 5 | Avg(N): | 6.1 | 7.2 |
| | CV (%): | 7.8 | 4.9 |
| Item 6 | Avg(N): | 15.9 | 13.5 |
| | CV (%): | 10.3 | 3.5 |
| Item 7 | Avg(N): | 4.2 | 4.8 |
| | CV (%): | 13.2 | 8.0 |

TABLE 10

| LAUNDRY EFFECT ON BULK DURABILITY (3 HOME LAUNDRIES AT 45° C.) | | |
|---|---|---|
| Identification | Initial Height (%) | Support Bulk (%) |
| Item 1 | +24.32 | +6.25 |
| Item 2 | +9.52 | 0.0 |
| Item 3 | +30.75 | +5.88 |
| Item 4 | +7.55 | −11.54 |
| Item 5 | 0.0 | 0.0 |
| Item 6 | +6.56 | −7.69 |
| Item 7 | −3.92 | −5.26 |

I claim:

1. An improved polyester fiberfill blend consisting essentially of, by weight, (a) from about 60 to about 95% of crimped polyester staple fiber, and (b) complementally, to total 100%, from about 5 to about 40% of crimped staple binder fiber, comprising a polymer having a binding temperature lower than the softening temperature of the said polyester staple fiber, characterized in that the said polyester stable fiber has a coating cured thereto of a slickener consisting essentially of chains of poly(alkylene oxide).

2. A blend according to claim 1, characterized in that the polyester staple fiber is coated with a segmented copolymer of poly(ethylene terephthalate) and poly(ethylene oxide) in amount from about 0.1 to about 1% by weight of the polyester staple fiber.

3. A blend according to claim 1, characterized in that the polyester staple fiber is coated with a modified poly(alkylene oxide) grafted with functional groups to permit crosslinking, in amount from about 0.1 to about 1% by weight of the polyester staple fiber.

4. A blend according to claim 1, 2 or 3, characterized in that the polyester staple fiber is coated with the slickener in amount from about 0.15% to about 0.6% by weight of the polyester staple fiber.

5. A through-bonded batt of polyester fiberfill of improved durability, and moisture transport, soft bonding, and low flammability, characterized in that the polyester fibers are coated with a slickener consisting essentially of chains of poly(alkylene oxide).

6. A batt according to claim 5, characterized in that the polyester fibers are coated with a segmented copolymer of poly(ethylene terephthalate) and poly(ethylene oxide) in amount from about 0.1 to about 1% by weight of the polyester fiber.

7. A batt according to claim 5, characterized in that the polyester fibers are coated with a modified poly(alkylene oxide) grafted with functional groups to permit crosslinking, in amount from about 0.1 to about 1% by weight of the polyester fiber.

8. A batt according to claim 6 or 7, characterized in that the polyester fibers are coated with the slickener in amount from about 0.15% to about 0.6% by weight of the polyester fiber.

9. A process for preparing a bonded batt of polyester fiberfill, wherein polyester fiber having a coating cured thereto of a slickener consisting essentially of chains of poly(alkylene oxide) is blended with binder fiber, the blend is formed into a batt, and the batt is heat-treated to cause the binder fiber to effect bonding at intersections of the coated polyester fiberfill.

10. A process according to claim 9, characterized in that the binder fibers are sheath/core fibers, whereby the sheath provides binder and the core remains in the bonded batt to provide points for bonding with the coated polyester fiberfill.

11. A process according to claim 9, characterized in the monocomponent binder fibers are used, whereby the binder bonds the coated polyester fiberfill at the cross over points.

12. A process according to claim 9, 10 or 11, characterized in that the polyester fiber is coated with a segmented copolymer of poly(ethylene terephthalate) and poly(ethylene oxide) in amount from about 0.1 to about 1% by weight of the polyester fiber.

13. A process according to claim 9, 10 or 11, characterized in that the polyester fiber is coated with a modified poly(alkylene oxide) grafted with functional groups to permit crosslinking, in amount from about 0.1 to about 1% by weight of the polyester fiber.

14. A process according to claim 9, 10, or 11, characterized in that the polyester fiber is coated with a segmented copolymer of poly(ethylene terephthalate) and poly(ethylene oxide) in amount from about 0.15 to about 0.6% by weight of the polyester fiber.

15. A process according to claim 9, 10 or 11, characterized in that the polyester fiber is coated with a modified poly(alkylene oxide) grafted with functional groups to permit crosslinking, in amount from about 0.15 to about 0.6% by weight of the polyester fiber.

* * * * *